US007422001B2

(12) United States Patent
Kaneko

(10) Patent No.: US 7,422,001 B2
(45) Date of Patent: Sep. 9, 2008

(54) ACCUMULATOR FUEL INJECTION APPARATUS FOR ENGINES

(75) Inventor: Takashi Kaneko, Sagamihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 11/812,669

(22) Filed: Jun. 20, 2007

(65) Prior Publication Data

US 2008/0110437 A1 May 15, 2008

(30) Foreign Application Priority Data

Nov. 10, 2006 (JP) ..... 2006-306050

(51) Int. Cl.
*F02M 69/46* (2006.01)
*F02M 69/50* (2006.01)

(52) U.S. Cl. ..... 123/456; 123/494

(58) Field of Classification Search ..... 123/465, 123/447, 470, 514, 382, 494
See application file for complete search history.

(56) References Cited

U.S. PATENT DOCUMENTS 5,311,850 A * 5/1994 Martin ..... 123/456
5,752,486 A * 5/1998 Nakashima et al. ..... 123/467
6,886,537 B2 * 5/2005 Kondo ..... 123/468
7,040,289 B2 * 5/2006 Nigrin et al. ..... 123/447
7,182,069 B2 * 2/2007 Nigrin et al. ..... 123/456
7,185,635 B2 * 3/2007 Frank et al. ..... 123/456
7,296,559 B2 * 11/2007 Kaneko ..... 123/447
2003/0084881 A1 * 5/2003 Mori ..... 123/456
2004/0139945 A1 * 7/2004 Kondo ..... 123/456
2006/0191514 A1 * 8/2006 Kaneko ..... 123/447

FOREIGN PATENT DOCUMENTS

JP 11-159372 A 6/1999
JP 3178105 B2 4/2001

* cited by examiner

*Primary Examiner*—Mahmoud Gimie
(74) *Attorney, Agent, or Firm*—Birch, Stewart, Kolasch & Birch, LLP

(57) ABSTRACT

An accumulator fuel injection apparatus is provided in which average pressure in the common rail can be detected by an extremely simple and inexpensive means with increased accuracy to be used as a control signal for controlling fuel injection. A pressure detection room is formed at an end part of the accumulation chamber such that the pressure detection room is connected to the accumulation chamber of the common rail, an orifice is provided between the pressure detection room and the accumulation chamber of the common rail to communicate the pressure detection room with the accumulation chamber by a throttled sectional area, and a common rail pressure sensor for detecting fuel pressure in the accumulation chamber is attached to an end of the common rail to face the pressure detection room.

3 Claims, 3 Drawing Sheets

ACCUMULATOR FUEL INJECTION APPARATUS FOR ENGINES

BACKGROUND OF THE INVENTION

1. Field of the Invention

This invention relates to a fuel injection apparatus and applied to a diesel engine, etc. equipped with an accumulator fuel injection apparatus, the apparatus having a common rail for storing high pressure fuel, the high pressure fuel in the common rail being supplied to fuel injection valves for injecting fuel into each of cylinders of the engine through a plurality of high pressure fuel outlets provided in the common rail equally spaced along longitudinal direction thereof.

2. Description of the Related Art

In the field of diesel engines, an accumulator fuel injection apparatus equipped with a common rail for accumulating high pressure fuel to be injected through injection valves to each of the engine cylinders is widely used in recent years.

In such an accumulator fuel injection apparatus, pulsation of fuel pressure occurs in the common rail due to periodical opening and closing of the fuel injection valves. As the high pressure fuel outlets are provided in the common rail at equal spacing to each other to supply high pressure fuel in the common rail to each of the engine cylinders via each of fuel injection pipes connected to each of the high pressure fuel outlets and fuel is injected at regular intervals, a stationary wave is generated in the common rail, which may affect next fuel injection.

There are disclosed fuel injection apparatuses to reduce such pulsation of fuel pressure for example in Japanese Patent No. 3178105 (patent literature 2) and in Japanese Laid-Open Patent Application No. 11-159372 (patent literature 2).

According to the patent literature 1, a pulsation suppression chamber of a certain volume is provided in a central part in the longitudinal direction of the accumulation chamber of the common rail to suppress fuel pressure pulsation in the accumulation chamber by the effect of the volume of the pulsation suppression chamber, and a common rail pressure sensor is located in the pulsation suppression chamber to detect fuel pressure in the suppression chamber, i.e. average pressure in the common rail.

According to the patent literature 2, an electronic control device calculates corrected fuel injection pressure based on a set value of fuel injection quantity, determines fuel injection pressure based on the calculated injection pressure and determines injection valve opening period taking into consideration the corrected fuel injection pressure. Therefore, even if the fuel pressure pulsation is generated in the fuel injection system due to fuel injection and a phenomenon occurs that reflected pressure wave coincides in phase with injection period of next cylinder, injection valve opening period is controlled taking into consideration expected effect of the reflection pressure wave, so an optimal fuel injection quantity for the engine in its operating condition and fuel pressure pulsating condition can be secured.

It is necessary to detect average fuel pressure in the accumulation chamber accurately without disturbed by the peak and minimum pressure of the pressure pulsation in the accumulation chamber when the fuel pressure in the accumulation chamber is to be used as signals for controlling fuel injection.

According to the art disclosed in the patent literature 1, a pulsation suppression chamber of a certain volume is provided in a central part in the longitudinal direction of the accumulation chamber of the common rail to suppress the fuel pressure pulsation in the accumulation chamber, so the volume of the pressure suppression chamber effects to reduces the rate of pressure rise in the accumulation chamber particularly at engine starting, which may harm engine startability. Further, as the common rail pressure sensor is positioned at the bottom of the pressure suppression chamber formed to extend perpendicularly to the accumulation chamber, responsivity of the common rail pressure sensor to pressure change in the accumulation chamber is reduced.

According to the art disclosed in the patent literature 2, corrected fuel injection pressure is calculated based on the set value of fuel injection quantity using the electronic control device, and fuel injection pressure is corrected based on the calculated injection pressure and fuel injection period is controlled in consideration of the corrected injection pressure. However, there is no teaching concerning the common rail pressure sensor.

SUMMARY OF THE INVENTION

The present invention was made in light of the problems mentioned above and its object is to propose an accumulator fuel injection apparatus for engines, in which average pressure in the common rail can be detected by an extremely simple and inexpensive means with increased accuracy to be used as a control signal for controlling fuel injection, without disturbed by peak and minimum pressure of the fuel pressure pulsation in the common rail.

To attain the object, the present invention proposes an accumulation fuel injection apparatus for engines, the apparatus having a common rail for accumulating high pressure fuel to be supplied to fuel injection valves of engine cylinders, the common rail having high pressure fuel outlets provided equally spaced in the common rail along longitudinal direction thereof for the high pressure fuel in a fuel accumulation chamber of the common rail to be supplied through the outlets to the fuel injection valves, characterized in that a pressure detection room is formed at an end part of said accumulation chamber such that said pressure detection room is connected to the accumulation chamber where the high pressure fuel outlets are provided, an orifice is provided between said pressure detection room and said accumulation chamber to communicate said pressure detection room with said accumulation chamber by a throttled sectional area, and a common rail pressure sensor for detecting fuel pressure in said accumulation chamber is attached to an end of the common rail to face said pressure detection room.

It is preferable that distance between a sensing end face of said common pressure sensor and said orifice is the same as the spacing between each of said high pressure fuel outlets, and that distance between said orifice and a center of a high pressure fuel outlet nearest to said orifice is the same as that of the spacing between each of said high pressure fuel outlets.

BRIEF DESCRIPTION OF THE DRAWINGS

FIG. 2B is a drawing for explaining attenuation of fuel pressure pulsation in the common rail.

DETAILED DESCRIPTION OF THE PREFERRED EMBODIMENTS

Preferred embodiments of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 3:
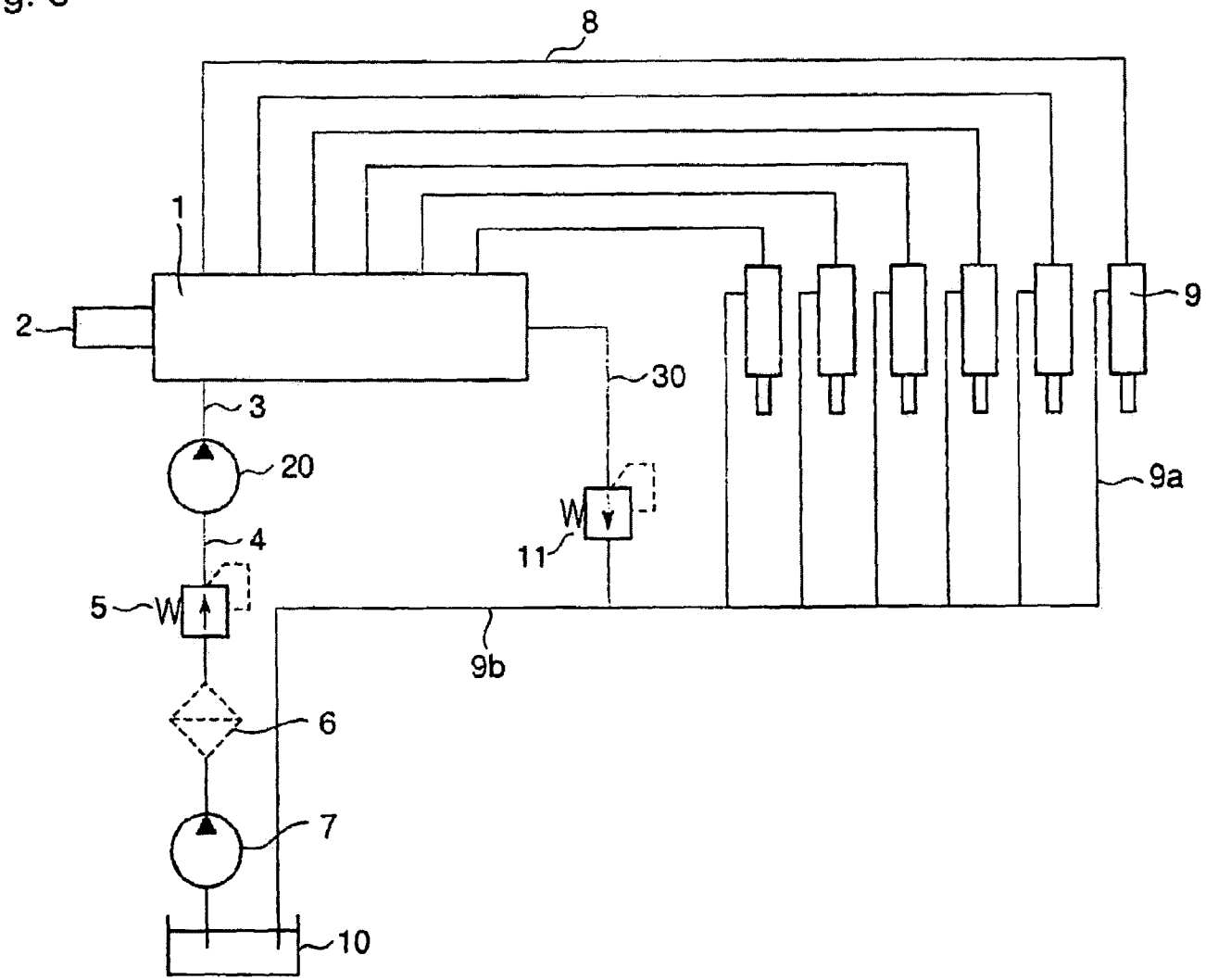
FIG. 3 is a schematic representation of all-over configuration of a diesel engine to which the accumulator fuel injection apparatus of the invention is applied.

FIG. 3 is a schematic representation of all-over configuration of a diesel engine to which the accumulator fuel injection apparatus of the invention is applied.

Referring to FIG. 3, a common rail 1 has an accumulation chamber 1*a* in its central part extending along longitudinal direction thereof as shown in FIG. 1. Fuel pressurized to high pressure by high pressure fuel pumps 20 is supplied to the accumulation chamber 1*a* through fuel discharge pipes 3 (only one pump and fuel discharge pipe are depicted in the drawing) and stored therein. Fuel is fed to the high pressure pump 20 from a fuel tank 10 by means of a fuel feed pump 7 through a fuel feed pipe 4 via a fuel filter 6 and a relief valve 5. Reference numeral 2 is a common rail pressure sensor for detecting fuel pressure in the accumulation chamber 1*a*.

High pressure fuel accumulated in the common rail 1 is supplied through a plurality of high pressure fuel outlets 21 drilled in the common rail 1 equally spaced along longitudinal direction thereof to be communicated with the accumulation chamber 1*a* thereof as shown in FIG. 1, and through fuel injection pipes 8 connected to the common rail 1 to fuel injection valves 9 to be injected therethrough into each of engine cylinders at determined injection timing.

Fuel returning from the fuel injection valves 9 returns to the fuel tank 10 via fuel return passages 9*a*. A maximum pressure in the accumulation chamber 1*a* is restricted by a relief valve 11 to be lower than a predetermined pressure. Fuel released through the relief valve 11 is returned to the fuel tank 10 via a fuel return passage 30 which joins together with the fuel return passage 9*b*.

The present invention relates to an improvement in the common rail and location of the common rail pressure sensor in the accumulator fuel injection apparatus composed as mentioned above.

The First Embodiment

Figure 1A:
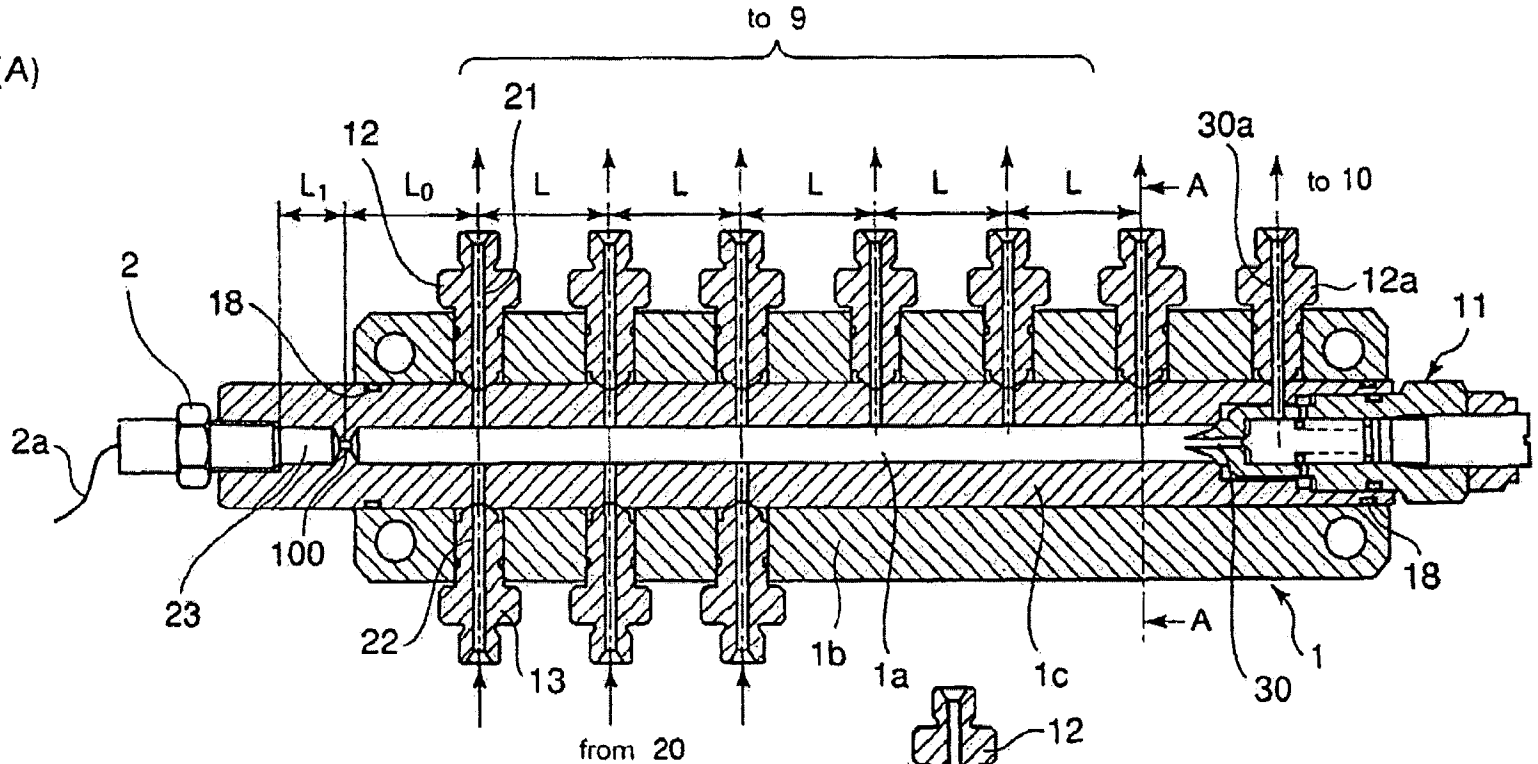
FIG. 1A is a longitudinal sectional view of the common rail of a first embodiment according to the present invention.
Figure 1B:
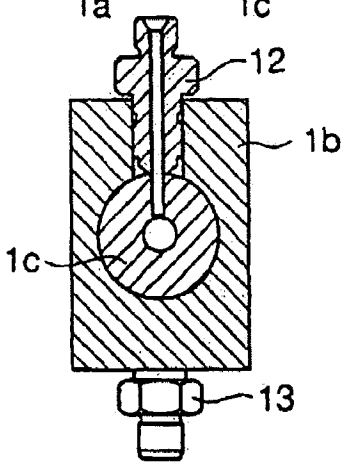
FIG. 1B is a section along lines A-A in FIG. 1A.

FIG. 1A is a longitudinal sectional view of the common rail of a first embodiment according to the present invention, and FIG. 1B is a section along lines A-A in FIG. 1A.

Referring to FIG. 1, the common rail 1 is composed of an inner tube 1*c* forming the accumulation chamber 1*a* extending along longitudinal direction thereof and an outer tube 1*b* into which the inner tube 1*c* is fitted. 'O' rings 18 are provided at near both ends of the inner tube to seal the fitting surfaces of both tubes.

Reference numeral 12 indicates a plurality of outlet connectors screwed into the outer tube 1*b* of the common rail 1 from the outer surface thereof to be fluid tight for connecting each of fuel outlets 21 of the common rail 1 to each of the injection pipes 8 connected to each of the injection valves 9 (see FIG. 3) of each of engine cylinders (six cylinders in this example), the fuel outlets being provided at equal spacing of L along longitudinal direction of the common rail.

Reference numeral 13 indicates three of inlet connectors (number of this connector may be 1 or a plural number other than 3) screwed into the outer tube 1*b* near to an end of the common rail 1. The inlet connectors 13 are connected to the high pressure pumps 20 via fuel discharge pipes 3 (see FIG. 3).

The relief valve 11 is screwed into the inner tube 1*c* of the common rail 1 at an end thereof fluid tight. The relief valve 11 is for releasing fuel in the accumulation chamber 1*a* of the common rail 1 when the pressure exceeds a predetermined pressure. Reference numeral 12*a* is a return connector screwed into the outer tube 1*b* of the common rail 1, fuel released through the relief valve 11 returns to the fuel tank 10 through a passage 30*a* in a return connector 12*a* and through the fuel return pipe 9*b*(see FIG. 3).

The common rail pressure sensor 2 for detecting fuel pressure in the accumulation chamber 1*a* of the common rail 1 is screwed into the other end thereof, and pressure detected by the pressure sensor 2 is sent to a fuel injection control device not shown in the drawing via an electric wire 2*a*.

An orifice 100 is provided between a pressure detection room 23 facing the sensing end of the pressure sensor 2 and the accumulation chamber 1*a*. Distance $L_1$ from the sensing end of the pressure sensor 2 to the orifice 100 and distance $L_0$ from the orifice 100 to a high pressure fuel outlets 21 positioned nearest to the pressure sensor 2 are determined to be appropriate values in consideration of fuel pressure pulsation in the fuel accumulation chamber 1*a* in the embodiment.

According to the first embodiment, as the orifice 100 is provided between the pressure detecting room 23 and fuel accumulation chamber 1*a*, fuel pressure pulsation in the accumulation chamber 1*a* is transmitted to the pressure detection room 23 in a highly attenuated state, so average pressure of the fuel accumulating chamber 1*a* can be detected always from the pressure not pulsating largely in the pressure detection room 23. Therefore, common rail pressure can be detected accurately with the pressure sensor 2 being not exposed directly to highly pulsating pressure in the accumulation chamber 1*a*.

The Second Embodiment

Figure 2:
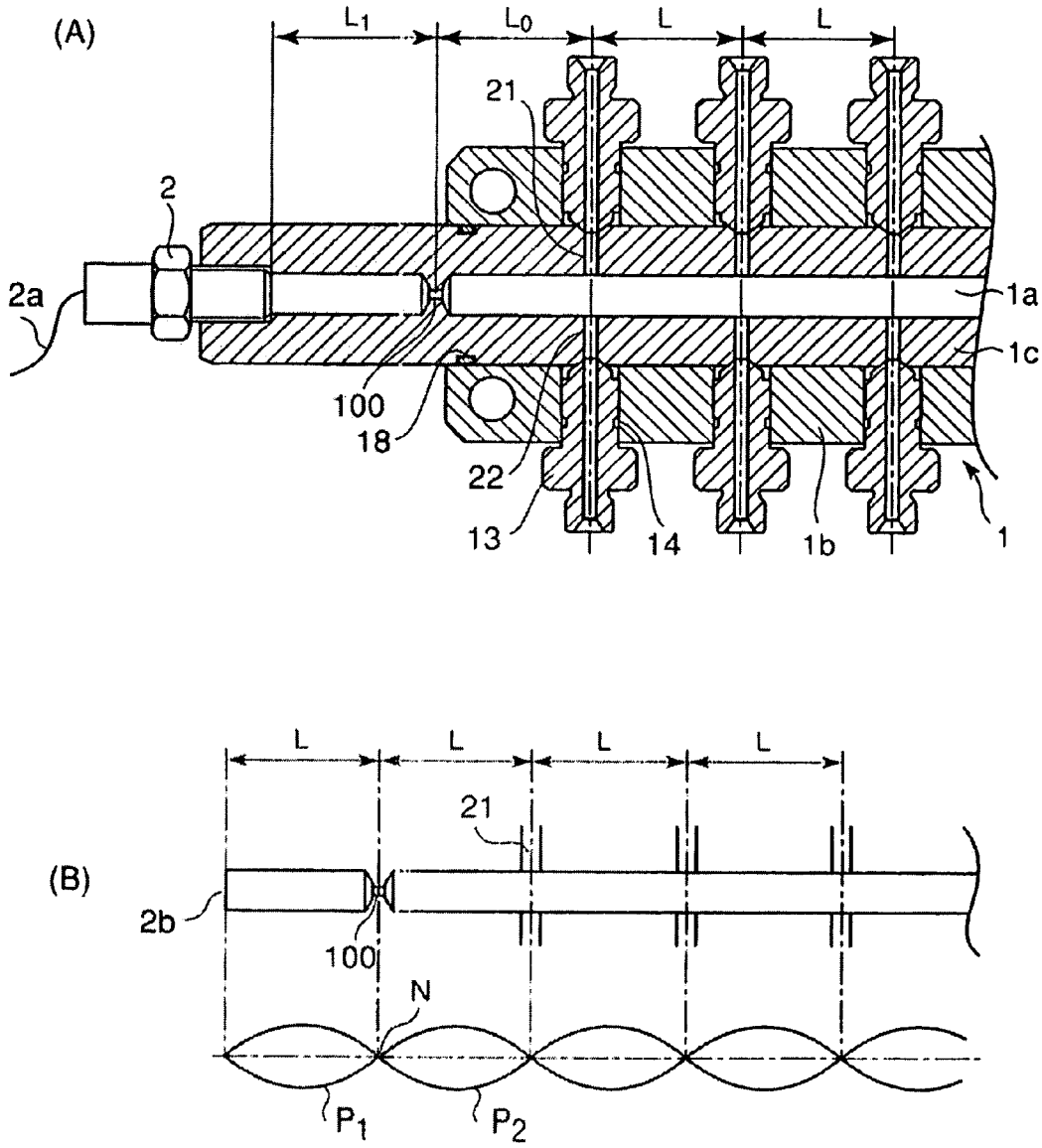
FIG. 2 is a longitudinal sectional view of the common rail of a second embodiment according to the present invention showing a common rail pressure sensor side part thereof.

FIG. 2A is a longitudinal sectional view of the common rail of a second embodiment according to the present invention showing a common rail pressure sensor side part thereof, and FIG. 2B is a drawing for explaining attenuation of fuel pressure pulsation in the common rail.

In the second embodiment, distance $L_1$ from the sensing end of the pressure sensor 2 to the orifice 100 is determined to be the same as the spacing L between each of the high pressure fuel outlets 21, and further distance $L_0$ from the orifice 100 to the center of the high pressure fuel outlets 21 positioned nearest to the pressure sensor 2 is determined to be the same as the spacing L.

Construction other than that is the same as that of the first embodiment, and constituent parts the same as those of the first embodiment is denoted by the same reference numerals.

As shown in FIG. 2B, in an accumulation fuel injection apparatus, fuel pressure fluctuation in the fuel accumulation chamber 1*a* occurs such that, both pressure wave $P_1$ initially generated and its reflected wave $P_2$ are overlapped resulting in pulsation of a number the same as that of fuel injection valve 9 connected to the high pressure fuel outlets 21 (i.e. the number of engine cylinders) having nodes N at the high pressure fuel outlets 21.

In the second embodiment, as distance $L_1$ from the sensing end face of the pressure sensor 2 to the orifice 100 is determined to be the same as the spacing L between each of the high pressure fuel outlets 21, fuel pressure at the vibration node at which pressure does not fluctuates exerts on the end face 2*b* of the common rail pressure sensor 2, so average fuel pressure can be detected.

Further, as distance $L_0$ from the orifice 100 to the center of the high pressure fuel outlets 21 positioned nearest to the pressure sensor 2 is determined to be the same as the spacing L between each of the high pressure fuel outlets 21, fuel pressure pulsation is attenuated by the orifice 100 positioned at a vibration node of the fuel pressure pulsation, fuel pressure further reduced in pressure pulsation amplitude exerts on the end face 2*b* of the common rail pressure sensor 2, so effect of detecting average fuel pressure is further increased.

According to the invention, by providing the orifice 100 between the pressure detection room 23 and the accumulation chamber 1*a*, fuel pressure pulsation transmitted from the accumulation chamber 1*a* to the pressure detection room 23 is attenuated by the throttling effect of the orifice 100, the common rail pressure sensor 2 detects average fuel pressure reduced in pressure fluctuation.

Therefore, common rail pressure can be detected accurately with the sensing end face of the pressure sensor being not exposed directly to highly pulsating pressure in the accumulation chamber without disturbed by peak and minimum pressure of the pressure fluctuation in the accumulation chamber 1*a*, and an accumulation fuel injection apparatus increased in accuracy of detecting fuel pressure in the common rail can be obtained.

Fuel pressure fluctuation in the accumulation chamber is generated as pressure fluctuation of a number the same as that of fuel injection valve connected to the high pressure fuel outlets (i.e. the number of engine cylinders) having nodes at the high pressure fuel outlets.

By determining distance $L_1$ from the sensing end face of the pressure sensor to the orifice to be the same as the spacing L between each of the high pressure fuel outlets, fuel pressure that does not fluctuates exerts on the sensing end face of the common rail pressure sensor, and average fuel pressure can be detected.

Further, by determining distance $L_0$ from the orifice to the center of a high pressure fuel outlets positioned nearest to the common rail pressure sensor to be the same as the spacing L between each of the high pressure fuel outlets, fuel pressure pulsation is attenuated by the orifice positioned at a vibration node of the fuel pressure pulsation, fuel pressure of further reduced in pulsation exerts on the end face of the common rail pressure sensor, so effect of detecting average fuel pressure is further increased.

The invention claimed is:

1. An accumulation fuel injection apparatus for engines, the apparatus having a common rail for accumulating high pressure fuel to be supplied to fuel injection valves of engine cylinders, the common rail having high pressure fuel outlets provided equally spaced in the common rail along longitudinal direction thereof for the high pressure fuel in a fuel accumulation chamber of the common rail to be supplied to the fuel injection valves, wherein a pressure detection room is formed at an end part of said accumulation chamber such that said pressure detection room is connected to the accumulation chamber where the high pressure fuel outlets are provided, an orifice is provided between said pressure detecting room and said accumulation chamber to communicate said pressure detection room with said accumulation chamber by a throttled sectional area, and a common rail pressure sensor for detecting fuel pressure in said accumulation chamber is attached to an end of the common rail to face said pressure detection room, wherein a distance between a sensing end face of said common rail pressure sensor and said orifice is the same as the spacing between each of said high pressure fuel outlets and wherein a distance between said orifice and a center of a high pressure fuel outlet positioned nearest to said orifice is the same as that of the spacing between each of said high pressure fuel outlets.

2. An accumulation fuel injection apparatus, comprising:

a common rail accumulating high pressure fuel to be supplied to fuel injection valves of cylinders, the common rail having high pressure fuel outlets being equally spaced apart by a distance of L in the common rail along a longitudinal direction for the high pressure fuel in a fuel accumulation chamber of the common rail to be supplied to the fuel injection valves, wherein a pressure detection room is formed at an end part of said accumulation chamber such that said pressure detection room is connected to the accumulation chamber where the high pressure fuel outlets are provided, an orifice is provided between said pressure detecting room and said accumulation chamber to communicate said pressure detection room with said accumulation chamber by a throttled sectional area, and a common rail pressure sensor for detecting fuel pressure in said accumulation chamber is attached to an end of the common rail to face said pressure detection room, wherein a distance between the end of said common rail pressure sensor and a center of said orifice is a distance of L0, and wherein a distance between the center of said orifice and a center of a high pressure fuel outlet positioned nearest to said orifice is a distance of L1, and wherein the distance of L and the distance L1 are equal to each other.

3. The accumulation fuel injection apparatus according to claim 2, wherein the distance of L, the distance L0, and the distance L1 are equal to each other.

* * * * *